US007673753B1

(12) United States Patent
Huckert

(10) Patent No.: US 7,673,753 B1
(45) Date of Patent: Mar. 9, 2010

(54) EDUCATIONAL DISH ASSEMBLY

(76) Inventor: Brent K. Huckert, 3035 Whispering Willow Way, Orange Park, FL (US) 32065

( * ) Notice: Subject to any disclaimer, the term of this patent is extended or adjusted under 35 U.S.C. 154(b) by 2 days.

(21) Appl. No.: 12/046,282

(22) Filed: Mar. 11, 2008

(51) Int. Cl.
*B65D 85/00* (2006.01)

(52) U.S. Cl. ..... 206/541; 206/459.1

(58) Field of Classification Search ..... 206/459.1, 206/459.5, 457, 564, 561, 541
See application file for complete search history.

(56) References Cited

U.S. PATENT DOCUMENTS 4,908,066 A 3/1990 Taylor et al.
D306,949 S 4/1990 Gebhardt
4,936,462 A 6/1990 Yuen
5,560,653 A 10/1996 Beppu
6,149,011 A 11/2000 Csengeri et al.
6,296,488 B1 * 10/2001 Brenkus et al. ..... 434/127
6,464,078 B1 * 10/2002 Grossnickle ..... 206/459.5
D586,623 S * 2/2009 Dunn ..... D7/541
2005/0045113 A1 3/2005 Wetterer et al.

* cited by examiner

*Primary Examiner*—Jacob K Ackun, Jr.

(57) ABSTRACT

An educational dish assembly includes a base that includes a bottom wall and a peripheral wall that is attached to and extends upwardly from the bottom wall. A dish includes a lower wall and a perimeter wall that is attached to and extends upwardly from the lower wall. The lower wall is translucent to allow viewing through the lower wall. The dish has a same size and shape as the base to allow the dish to be positioned in the base and the perimeter wall abut and be aligned with the peripheral wall. At least one plate has an upper surface. The upper surface has indicia thereon to educate a child viewing the indicia. The at least one plate is positioned between the base and the dish.

5 Claims, 4 Drawing Sheets

EDUCATIONAL DISH ASSEMBLY

BACKGROUND OF THE INVENTION

Field of the Invention

The present invention relates to educational dish devices and more particularly pertains to a new educational dish device for holding educational indicia which can be viewed by a child while a child eat from the dish device.

SUMMARY OF THE INVENTION

The present invention meets the needs presented above by generally comprising a base that includes a bottom wall and a peripheral wall that is attached to and extends upwardly from the bottom wall. A dish includes a lower wall and a perimeter wall that is attached to and extends upwardly from the lower wall. The lower wall is translucent to allow viewing through the lower wall. The dish has a same size and shape as the base to allow the dish to be positioned in the base and the perimeter wall abut and be aligned with the peripheral wall. At least one plate has an upper surface. The upper surface has indicia thereon to educate a child viewing the indicia. The at least one plate is positioned between the base and the dish.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
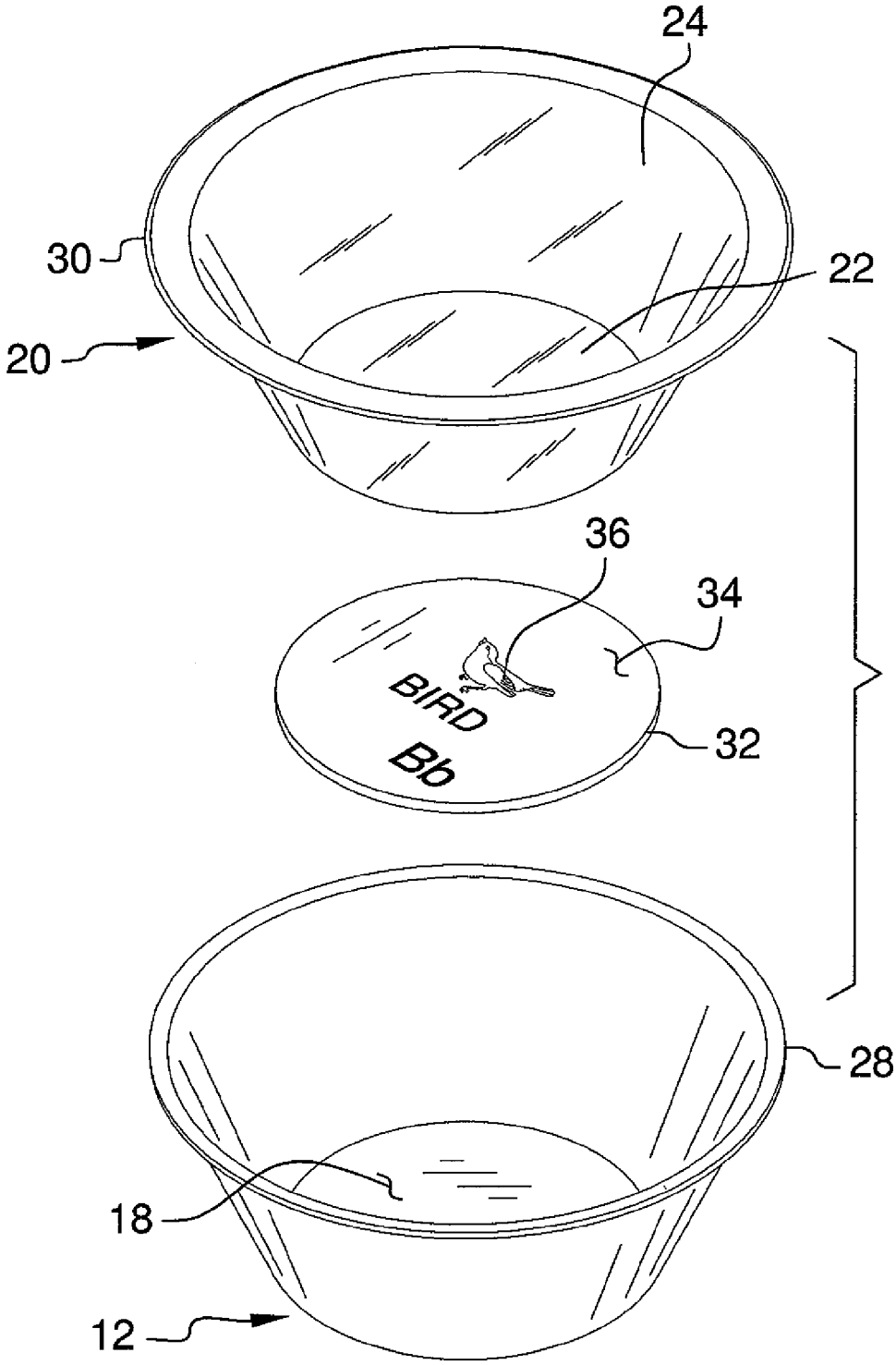
FIG. 1 is a front perspective view of a educational dish assembly according to the present invention.
Figure 2:
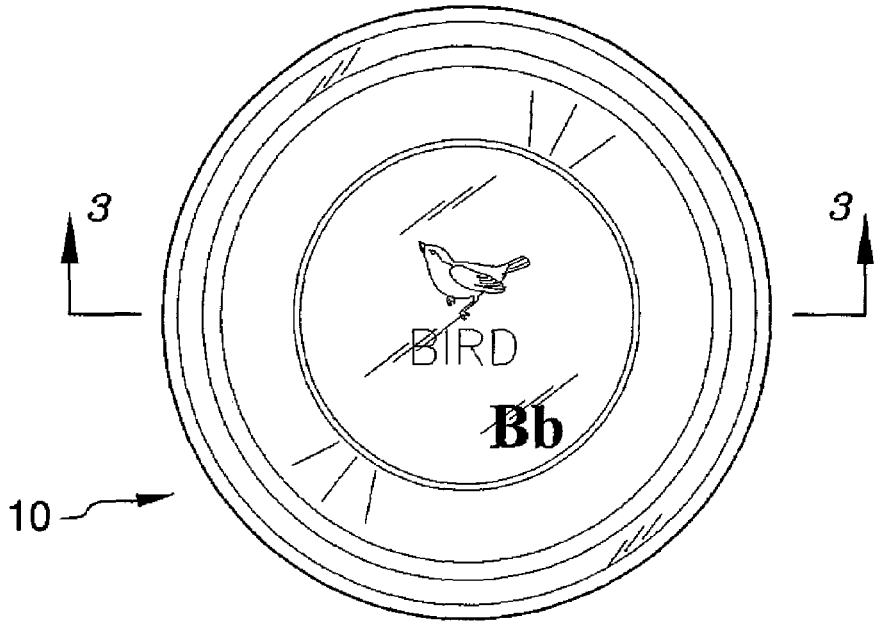
FIG. 2 is a top view of the present invention.
Figure 3:
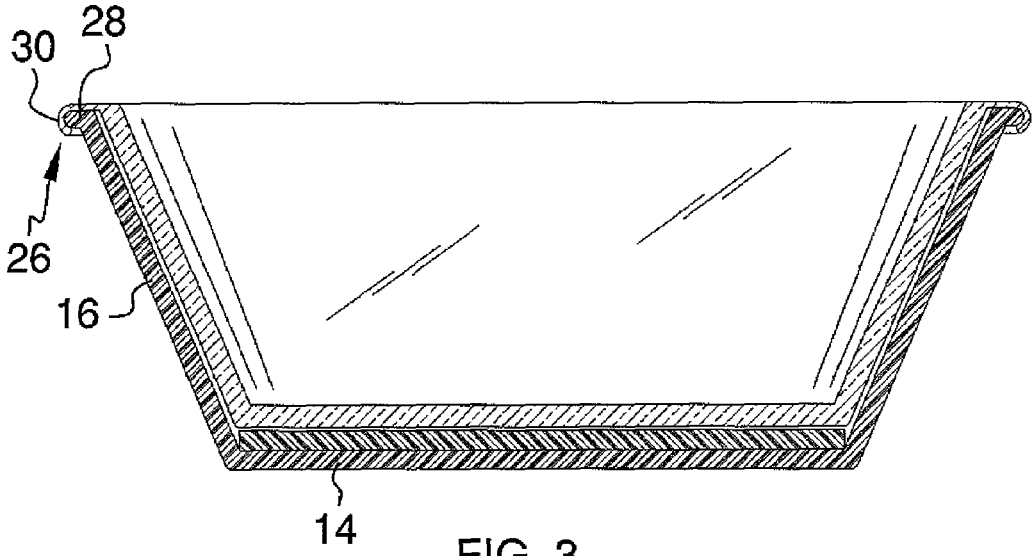
FIG. 3 is a cross-sectional view taken along line 3-3 of FIG. 2 of the present invention.
Figure 4:
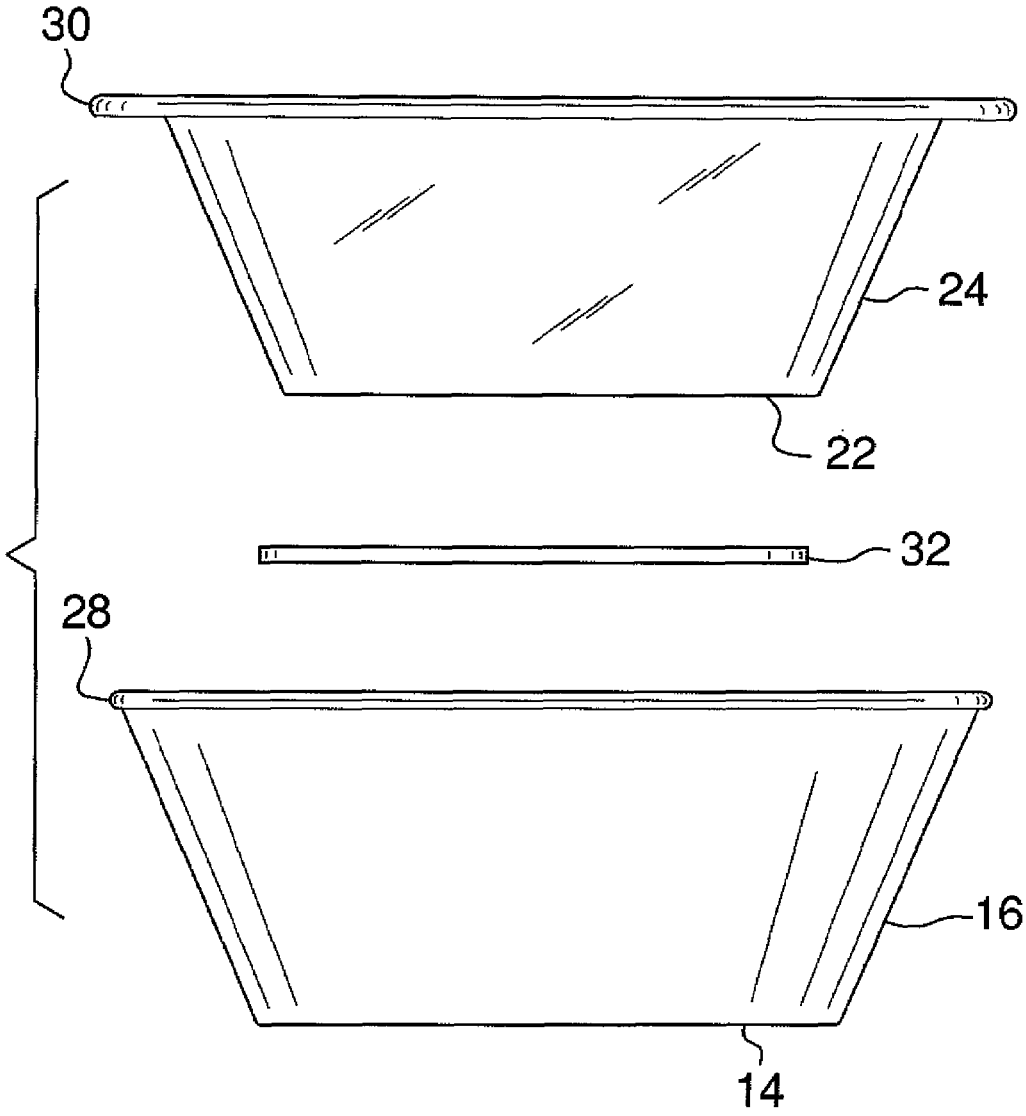
FIG. 4 is a side expanded view of the present invention.
Figure 5:
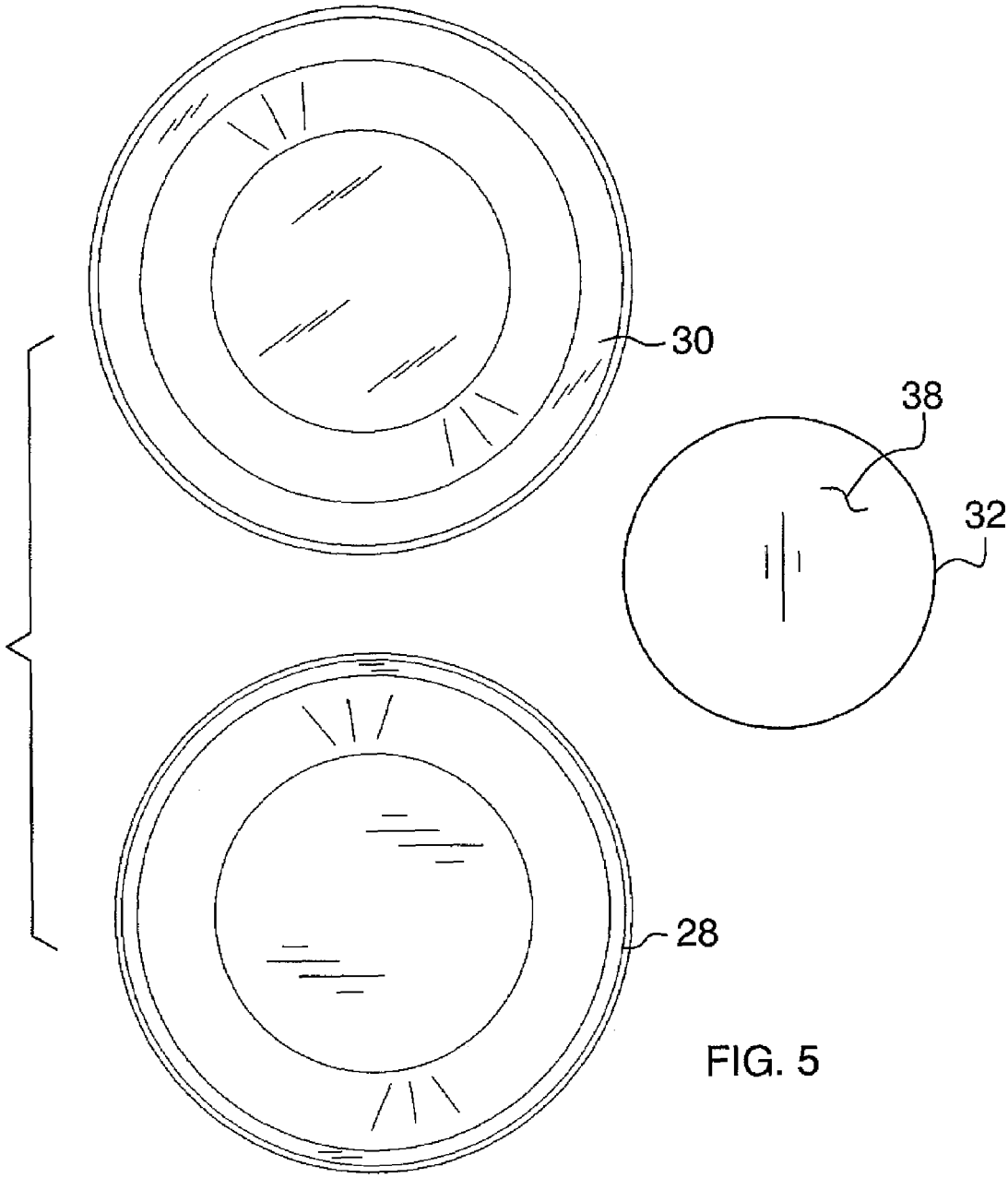
FIG. 5 is a bottom view of the present invention.

With reference now to the drawings, and in particular to FIGS. 1 through 5 thereof, a new educational dish device embodying the principles and concepts of the present invention and generally designated by the reference numeral 10 will be described.

As best illustrated in FIGS. 1 through 5, the educational dish assembly 10 generally comprises a base 12 that includes a bottom wall 14 and a peripheral wall 16 that is attached to and extends upwardly from the bottom wall 14. An angle between an upper side 18 of the bottom wall 14 and the peripheral wall 16 is between 100 degrees and 160 degrees.

The bottom wall 14 is circular shaped and the base is dish shaped, and more particular bowl shaped.

A dish 20 includes a lower wall 22 and a perimeter wall 24 that is attached to and extends upwardly from the lower wall 22. The lower wall 22 is translucent to allow viewing through the lower wall 22. The dish 20 has a same size and shape as the base 12 to allow the dish 20 to be positioned in the base 12 and the perimeter wall 24 abut and be aligned with the peripheral wall 16.

A coupler 26 releasably couples the dish 20 to the base 12 when the dish 20 is positioned in the base 12. The coupler 26 includes a peripheral lip 28 that is attached to and coextensive with an upper edge of the peripheral wall 16. The peripheral lip 28 extends outwardly from the peripheral wall 16. A perimeter flange 30 is attached to and coextensive with an upper edge of the perimeter wall 24. The flange 30 is hook shaped and defines a female connector that receives and snappily couples with the peripheral lip 28. To release the dish from the base, the flange is pulled away from the lip to release the lip from the flange.

At least one plate 32 is provided that has an upper surface 34. The upper surface 34 has indicia 36 thereon to educate a child viewing the indicia 36. The at least one plate 32 is positioned between the base 12 and the dish 20 and secured there by the coupler 26. Typically, a plurality of plates 32 is provided, each with different indicia thereon, so that the plates 32 can be replaced from between the base 12 and the dish 20 as desired by the user of the assembly 10. A lower surface 38 of the plate may also include indicia to allow the plate 32 to simply be turned over to show alternate indicia.

In use, the dish 20 is used as a conventional bowl or dish out which a child will eat. While the child eats, the plate 32 will be viewable through the dish 20 and child will be educated and entertained by the indicia 36 on the plate 32. When the child tires of a particular plate 32, it may be replaced with a different plate 32.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An educational food dish system comprising:

a base including a bottom wall and a peripheral wall being attached to and extending upwardly from said bottom wall;

a dish including a lower wall and a perimeter wall being attached to and extending upwardly from said lower wall, said lower wall being translucent to allow viewing through said lower wall, said dish having a same size and shape as said base to allow said dish to be positioned in said base and said perimeter wall abut and be aligned with said peripheral wall;

at least one plate having an upper surface, said upper surface having indicia thereon to educate a child viewing the indicia, said at least one plate being positioned between said base and said dish; and a coupler releasably coupling said dish to said base when said dish is positioned in said base.

2. The system according to claim 1, wherein an angle between an upper side of said bottom wall and said peripheral wall is between 100 degrees and 160 degrees.

3. The system according to claim 2, wherein said bottom wall is circular shaped.

4. The system according to claim 1, wherein said coupler includes:

a peripheral lip being attached to and coextensive with an upper edge of said peripheral wall, said peripheral lip extending outwardly from said peripheral wall; and a perimeter flange being attached to and coextensive with an upper edge of said perimeter wall, said flange being hook shaped and defining a female connector, said female connector receiving and snappily coupling with said peripheral lip.

5. An educational food dish system comprising;

a base including a bottom wall and a peripheral wall being attached to and extending upwardly from said bottom wall, an angle between an upper side of said bottom wall and said peripheral wall being between 100 degrees and 160 degrees, said bottom wall being circular shaped and said base being dish shaped;

a dish including a lower wall and a perimeter wall being attached to and extending upwardly from said lower wall, said lower wall being translucent to allow viewing through said lower wall, said dish having a same size and shape as said base to allow said dish to be positioned in said base and said perimeter wall abut and be aligned with said peripheral wall;

a coupler releasably coupling said dish to said base when said dish is positioned in said base, said coupler including;

a peripheral lip being attached to and coextensive with an upper edge of said peripheral wall, said peripheral lip extending outwardly from said peripheral wall;

a perimeter flange being attached to and coextensive with an upper edge of said perimeter wall, said flange being hook shaped and defining a female connector, said female connector receiving and snappily coupling with said peripheral lip; and at least one plate having an upper surface, said upper surface having indicia thereon to educate a child viewing the indicia, said at least one plate being positioned between said base and said dish.

* * * * *